US007769340B2

(12) United States Patent
Grau et al.

(10) Patent No.: US 7,769,340 B2
(45) Date of Patent: Aug. 3, 2010

(54) METHOD AND SYSTEM FOR PROGRAM DATA DISSEMINATION

(75) Inventors: Thomas P. Grau, Rochester, MI (US); Matt C. Videtich, Farmington Hills, MI (US); Mingheng Wang, Rochester Hills, MI (US)

(73) Assignee: General Motors LLC, Detroit, MI (US)

( * ) Notice: Subject to any disclaimer, the term of this patent is extended or adjusted under 35 U.S.C. 154(b) by 1330 days.

(21) Appl. No.: 10/940,532

(22) Filed: Sep. 14, 2004

(65) Prior Publication Data

US 2006/0057956 A1 Mar. 16, 2006

(51) Int. Cl.
*H04H 20/71* (2008.01)

(52) U.S. Cl. ..... 455/3.01; 455/158.5; 455/227.1

(58) Field of Classification Search ..... 455/3.01
See application file for complete search history.

(56) References Cited

U.S. PATENT DOCUMENTS

| | | | | |
|---|---|---|---|---|
| 7,113,572 | B2 * | 9/2006 | Holmes | 379/88.14 |
| 2002/0183059 | A1 * | 12/2002 | Noreen et al. | 455/427 |
| 2005/0065711 | A1 * | 3/2005 | Dahlgren et al. | 701/117 |
| 2005/0206509 | A1 * | 9/2005 | Becker et al. | 340/426.19 |

* cited by examiner

*Primary Examiner*—Duc Nguyen
*Assistant Examiner*—Ajibola Akinyemi

(57) ABSTRACT

A method and system for providing a user of a mobile vehicle with informational associated with a transmitted satellite radio program. The call center receives a data request for informational data associated with a radio program at a call center from a telematics unit via a wireless network. A determination is made of at least one informational data associated with the data request. The determined informational data is sent to a user communication device.

14 Claims, 4 Drawing Sheets

METHOD AND SYSTEM FOR PROGRAM DATA DISSEMINATION

FIELD OF THE INVENTION

This invention relates generally to a telematics and satellite digital audio radio systems in a mobile vehicle. In particular, the invention relates to a method, computer usable medium and system for providing information associated with a transmitted satellite radio program responsive to a request by a user of a mobile vehicle.

BACKGROUND OF THE INVENTION

The opportunity to personalize features in a mobile vehicle is ever increasing as the automobile is being transformed into a communications and entertainment platform as well as a transportation platform. Projections are that by 2006 a majority of new American cars will be installed with some type of telematics unit to provide wireless communication and location-based services. These services may be accessed through interfaces such as voice-recognition computer applications, touch-screen computer displays, computer keyboards, or a series of buttons on the dashboard or console of a vehicle.

Currently, telematics service call centers, in-vehicle compact disk (CD) or digital video display (DVD) media, web portals, and voice-enabled phone portals provide various types of location services, including driving directions, stolen vehicle tracking, traffic information, weather reports, restaurant guides, ski reports, road condition information, accident updates, street routing, landmark guides, and business finders.

For example, traffic and driving directions are accessible through a voice portal that uses incoming number identification to generate location information based on the area code or prefix of the phone number, or to access location information stored in a user's profile associated with the phone number. In some embodiments, users are prompted to enter more details through a voice interface. Other examples are web and wireless portals that offer location-based services such as maps and driving directions where the user enters both a start and end addresses. Some of these services have a voice interface.

Some telematics service users elect to establish a mobile vehicle satellite radio service account, such as Satellite Digital Audio Radio Service (SDARS), as well as a telematics system account. The SDARS system provides radio broadcast reception for vehicles in remote locations which otherwise would be unable to pick up a radio signal.

SDARS subscribers are often exposed to many unique broadcasts and songs that are typically not aired on traditional AM and FM radio. SDARS providers typically broadcast the song titles and the artist names along with the broadcasted songs. Many satellite receiver systems have the capability to display the song titles and artist names on visual display devices while the song is being broadcast. Currently when the song ends, the song title and artist name are no longer broadcasted and are therefore no longer displayed. The broadcasted song titles and artist names are not stored in satellite radio receiver systems or telematics units. The SDARS subscriber is typically engaged operating the mobile vehicle and therefore unable to copy the song title and artist name for future access and review.

Prior art smart key fobs have been specifically programmed to enable a user to download and store the song title and artist name from satellite radio receivers for future access and review. Such devices typically have to be networked to a personal computer to gain access to and download the stored song data. Smart key fobs often have a limited amount of available memory thereby limiting the amount of song data that can be stored.

It is desirable to provide a method, computer usable medium and system to overcome the limitations described above. It is desirable to provide the user of a mobile vehicle with the option of selecting a broadcasted radio song and requesting that informational data associated with the selected radio song be forwarded to a user communication device for future access and review.

SUMMARY OF THE INVENTION

One aspect of the present invention provides a method for providing a user of a mobile vehicle with information associated with a transmitted satellite radio program. The method includes receiving a data request for informational data associated with a radio program at a call center from a telematics unit via a wireless network, determining at least one informational data associated with the data request, and sending the determined informational data to a user communication device.

A second aspect of the invention provides a system for providing a user of a mobile vehicle with information associated with a transmitted satellite radio program. The system includes means for receiving a data request for informational data associated with a radio program at a call center from a telematics unit via a wireless network, means for determining at least one informational data associated with the data request, and means for sending the determined informational data to a user communication device.

A third aspect of the invention provides a computer readable medium storing a computer program for providing a user of a mobile vehicle with information associated with a transmitted satellite radio program. The medium comprises computer readable code for receiving a data request for informational data associated with a radio program at a call center from a telematics unit via a wireless network, computer readable code for determining at least one informational data associated with the data request, and computer readable code for sending the determined informational data to a user communication device.

The foregoing and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

BRIEF DESCRIPTION OF THE DRAWINGS

Various embodiments of the present invention are illustrated by the accompanying figures, wherein.

DETAILED DESCRIPTION OF THE PRESENTLY PREFERRED EMBODIMENTS

Figure 1:
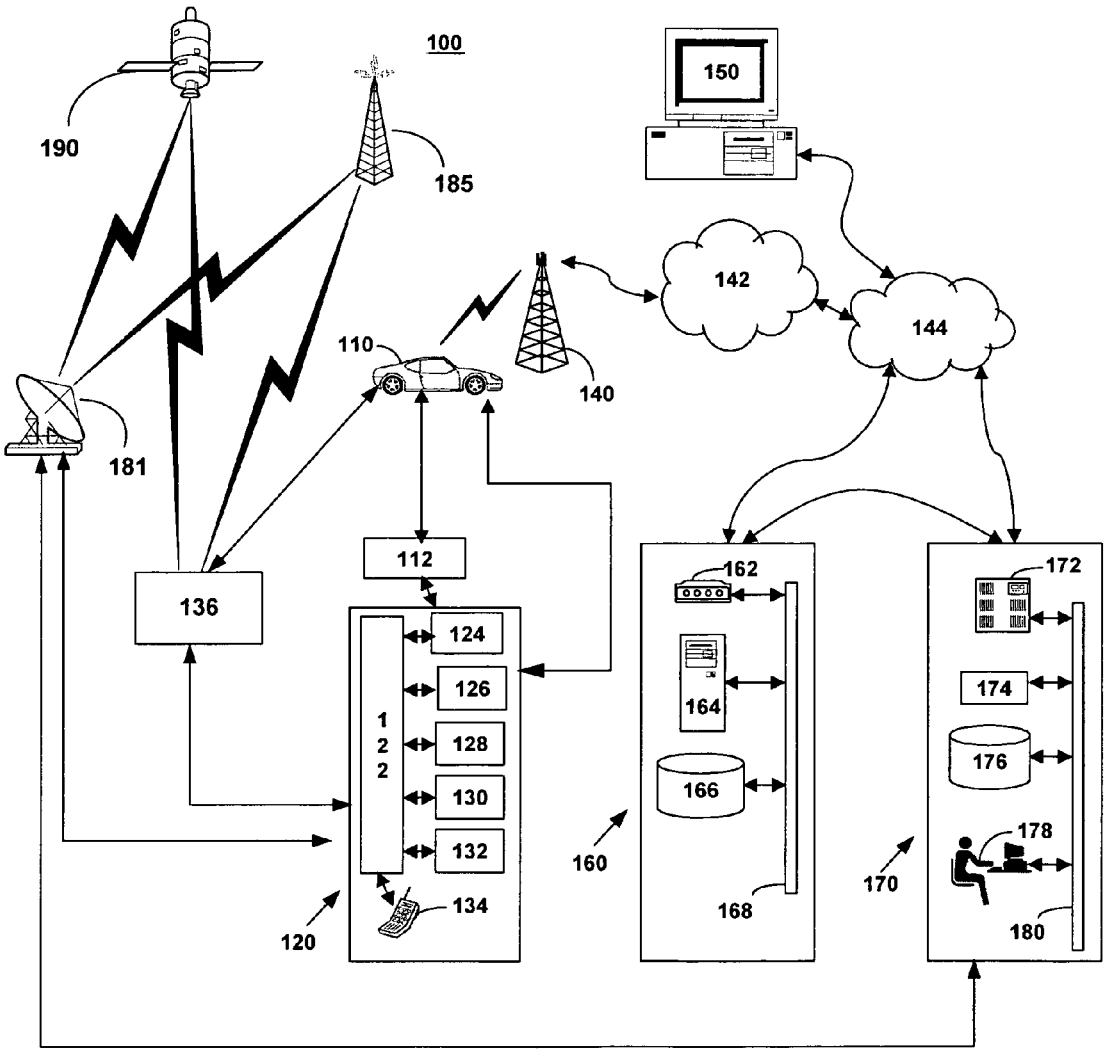
FIG. 1 is a schematic diagram of a system for data transmission over a wireless communication system integrated with a satellite digital audio radio service (SDARS) system, in accordance with the present invention.

FIG. 1 is a schematic diagram of a system for data transmission over a wireless communication system integrated with a satellite digital audio radio service (SDARS) system, in accordance with the present invention. Mobile vehicle communication system (MVCS) 100 includes a mobile vehicle communication unit (MVCU) 110, a vehicle communication network 112, a telematics unit 120, a satellite radio receiver system 136, one or more wireless carrier systems 140, one or more communication networks 142, one or more land networks 144, one or more satellite radio service uplink facilities 181, one or more terrestrial radio transmitters 185, one or more satellite radio service geostationary satellites 190, one or more client, personal or user computers 150, one or more web-hosting portals 160, and one or more call centers 170. In one embodiment, MVCU 110 is implemented as a mobile vehicle equipped with suitable hardware and software for transmitting and receiving voice and data communications. In one embodiment, MVCS 100 includes additional components not relevant to the present discussion. Mobile vehicle communication systems, telematics units and SDARS are known in the art.

MVCU 110 is also referred to as a mobile vehicle throughout the discussion below. In operation, MVCU 110 may be implemented as a motor vehicle, a marine vehicle, or as an aircraft. In one embodiment, MVCU 110 includes additional components not relevant to the present discussion.

MVCU 110, via a vehicle communication network 112, sends signals to various units of equipment and systems (detailed below) within MVCU 110 to perform various functions such as unlocking a door, opening the trunk, setting personal comfort settings, and calling from telematics unit 120. In facilitating interactions among the various communication and electronic modules, vehicle communication network 112 utilizes network interfaces such as controller-area network (CAN), International Organization for Standardization (ISO) Standard 9141, ISO Standard 11898 for high-speed applications, ISO Standard 11519 for lower speed applications, and Society of Automotive Engineers (SAE) Standard J1850 for high-speed and lower speed applications.

MVCU 110, via telematics unit 120, sends and receives radio transmissions from wireless carrier system 140. Wireless carrier system 140 is implemented as any suitable system for transmitting a signal from MVCU 110 to communication network 142.

Telematics unit 120 includes a processor 122 connected to a wireless modem 124, a global positioning system (GPS) unit 126, an in-vehicle memory 128, a microphone 130, one or more speakers 132, and an embedded or in-vehicle mobile phone 134. In other embodiments, telematics unit 120 may be implemented without one or more of the above listed components, such as, for example GPS unit 126 or speakers 132. In some embodiments telematics unit 120 includes additional components not relevant to the present discussion.

In one embodiment, processor 122 is a digital signal processor (DSP). In one embodiment processor 122 is implemented as a microcontroller, microprocessor, controller, host processor, or vehicle communications processor. In an example, processor 122 is implemented as an application specific integrated circuit (ASIC). In another embodiment, processor 122 is implemented as a processor working in conjunction with a central processing unit (CPU) performing the function of a general purpose processor. GPS unit 126 provides longitude and latitude coordinates of the vehicle responsive to a GPS broadcast signal received from a one or more GPS satellite broadcast systems (not shown). In-vehicle mobile phone 134 is a cellular-type phone, such as, for example an analog, digital, dual-mode, dual-band, multi-mode or multi-band cellular phone.

Processor 122 executes various computer programs that control programming and operational modes of electronic and mechanical systems within MVCU 110. Processor 122 controls communications (e.g. call signals) between telematics unit 120, wireless carrier system 140, terrestrial radio transmitter 185 or a satellite radio geostationary satellite 180 and call center 170. In one embodiment, a voice-recognition application is installed in processor 122 that can translate human voice input through microphone 130 to digital signals. Processor 122 generates and accepts digital signals transmitted between telematics unit 120 and a vehicle communication network 112 that is connected to various electronic modules in the vehicle. In one embodiment, these digital signals activate the programming mode and operation modes, as well as provide for data transfers. In one embodiment, signals from processor 122 are translated into voice messages and sent out through speaker 132.

Communication network 142 includes services from one or more mobile telephone switching offices and wireless networks. Communication network 142 connects wireless carrier system 140 to land network 144. Communication network 142 is implemented as any suitable system or collection of systems for connecting wireless carrier system 140 to MVCU 110 and land network 144.

Land network 144 connects communication network 142 to client computer 150, web-hosting portal 160, and call center 170. In one embodiment, land network 144 is a public-switched telephone network (PSTN). In another embodiment, land network 144 is implemented as an Internet protocol (IP) network. In other embodiments, land network 144 is implemented as a wired network, an optical network, a fiber network, other wireless networks, or any combination thereof. Land network 144 is connected to one or more land-line telephones. Communication network 142 and land network 144 connect wireless carrier system 140 to web-hosting portal 160 and call center 170.

Client, personal or user computer 150 includes a computer usable medium to execute Internet browser and Internet-access computer programs for sending and receiving data including emails over land network 144 and optionally, wired or wireless communication networks 142 to web-hosting portal 160. Personal or client computer 150 sends user preferences to web-hosting portal through a web-page interface using communication standards such as hypertext transport protocol (HTTP), and transport-control protocol and Internet protocol (TCP/IP). In one embodiment, the data includes directives to change certain programming and operational modes of electronic and mechanical systems within MVCU 110. In operation, a client utilizes computer 150 to initiate setting or re-setting of user-preferences for MVCU 110. User-preference data from client-side software is transmitted to server-side software of web-hosting portal 160. User-preference data is stored at web-hosting portal 160.

Web-hosting portal 160 includes one or more data modems 162, one or more web servers 164, one or more databases 166, and a network system 168. Web-hosting portal 160 is connected directly by wire to call center 170, or connected by phone lines to land network 144, which is connected to call center 170. In an example, web-hosting portal 160 is connected to call center 170 utilizing an IP network. In this example, both components, web-hosting portal 160 and call center 170, are connected to land network 144 utilizing the IP network. In another example, web-hosting portal 160 is connected to land network 144 by one or more data modems 162. Land network 144 sends digital data to and from modem 162, data that is then transferred to web server 164. In one embodiment modem 162 resides inside web server 164. Land network 144 transmits data communications between web-hosting portal 160 and call center 170.

Web server 164 receives user-preference data from user computer 150 via land network 144. In alternative embodiments, computer 150 includes a wireless modem to send and receive data to and from web-hosting portal 160 through a wireless communication network 142 and a land network 144. Data is sent and received by land network 144 and sent and received to and from one or more web servers 164. In one embodiment, web server 164 is implemented as any suitable hardware and software capable of providing web services to help change and transmit personal preference settings from a client at computer 150 to telematics unit 120 in MVCU 110. Web server 164 sends to or receives from one or more databases 166 data transmissions via network system 168. Web server 164 includes computer applications and files for managing and storing personalization settings supplied by the client, such as door lock/unlock behavior, radio station preset selections, climate controls, custom button configurations and theft alarm settings. For each client, the web server potentially stores hundreds of preferences for wireless vehicle communication, networking, maintenance and diagnostic services for a mobile vehicle.

In one embodiment, one or more web servers 164 are networked via network system 168 to distribute user-preference data among its network components such as database 166. In an example, database 166 is a part of or a separate computer from web server 164. Web server 164 sends data transmissions with user preferences to call center 170 through land network 144.

Call center 170 is a location where many calls are received and serviced at the same time, or where many calls are sent at the same time. In one embodiment, the call center 170 is a telematics call center, facilitating communications to and from telematics unit 120 in MVCU 110. In an example, the call center 170 is a voice call center, providing verbal communications between an advisor in the call center and a subscriber in a mobile vehicle. In another example, the call center 170 contains each of these functions. In other embodiments, call center 170 and web-hosting portal 160 are located in the same or different facilities.

Call center 170 contains one or more voice and data switches 172, one or more communication services managers 174, one or more communication services and informational databases 176, one or more communication services advisors 178, and one or more network systems 180.

Switch 172 of call center 170 connects to land network 144. Switch 172 transmits voice or data transmissions from call center 170, and receives voice or data transmissions from telematics unit 120 in MVCU 110 through wireless carrier system 140, communication network 142, and land network 144. Switch 172 receives data transmissions from and sends data transmissions to one or more web-hosting portals 160. Switch 172 receives data transmissions from or sends data transmissions to one or more communication services managers 174 via one or more network systems 180.

Communication services manager 174 is any suitable hardware and software capable of providing requested communication services to telematics unit 120 in MVCU 110. Communication services manager 174 sends to or receives from one or more communication services and/or informational databases 176 data transmissions via network system 180. Communication services manager 174 sends to or receives from one or more communication services advisors 178 data transmissions via network system 180. Communication services 176 sends to or receives from communication services advisor 178 data transmissions via network system 180. Communication services advisor 178 receives from or sends to switch 172 voice or data transmissions.

Communication services manager 174 provides one or more of a variety of services, including enrollment services, navigation assistance, directory assistance, roadside assistance, business or residential assistance, information services assistance, emergency assistance, and communications assistance. In one embodiment, communication services manager 174 processes data requests from a mobile vehicle user for information associated with transmitted satellite radio programs. Communication services manager 174 receives service-preference requests for a variety of services from the client via computer 150, web-hosting portal 160 and land network 144. Communication services manager 174 transmits user-preference and other data to telematics unit 120 in MVCU 110 through wireless carrier system 140, communication network 142, land network 144, voice and data switch 172, and network system 180. Communication services manager 174 stores or retrieves data and information from communication services and informational database 176. In some embodiments, communication services manager 174 is operable to provide requested information to communication services advisor 178. In one embodiment, communication services advisor 178 is implemented as a real advisor. In an example, a real advisor is a human being in verbal communication with a user or subscriber (e.g. a client) in MVCU 110 via telematics unit 120. In another embodiment, communication services advisor 178 is implemented as a virtual advisor. In an example, a virtual advisor is implemented as a synthesized voice interface responding to requests from telematics unit 120 in MVCU 110.

Communication services advisor 178 provides services to telematics unit 120 in MVCU 110. Services provided by communication services advisor 178 include enrollment services, navigation assistance, real-time traffic advisories, directory assistance, roadside assistance, business or residential assistance, information services assistance, emergency assistance, and communications assistance. Communication services advisor 178 communicate with telematics unit 120 in MVCU 110 through wireless carrier system 140, communication network 142, and land network 144 using voice transmissions, or through communication services manager 174 and switch 172 using data transmissions. Switch 172 selects between voice transmissions and data transmissions.

The SDARS system includes a satellite radio uplink facility 181 that sends and receives radio signals to a geostationary satellite 190. Terrestrial radio transmitter 185 and geostationary satellite 190 transmit radio signals to satellite radio receiver system 136 in MVCU 110. In one embodiment, terrestrial radio transmitter 185 and geostationary satellite 190 broadcast over a spectrum in the S band (2.3 GHz) that has been allocated by the U.S. Federal Communications Commission (FCC) for nationwide broadcasting of Satellite Based Digital Radio Service (SDARS). An exemplary broadcast has a 120 kilobyte per second portion of the bandwidth designated for command signals from telematics service call center 170.

The SDARS system broadcasts music and entertainment, traffic information, road construction information, advertisements, news and information on local events. The SDARS system also transmits informational data associated with the radio program being broadcast. In one embodiment, the informational data includes the names of the broadcasted radio program and radio program artist. For example, if the radio program is a song, the informational data includes the names of the song and the singer. In one embodiment, the informational data includes a unique satellite radio program identifier assigned by a SDARS provider that identifies the specific version of the radio program being broadcast. For example, if the radio program is a song, the unique satellite radio program identifier identifies the specific version of the song.

In one embodiment, satellite radio receiver system 136 is separate from telematics unit 120. In an alternative embodiment, satellite radio receiver system 136 is electronically connected to telematics unit 120 with a cable or over the vehicle communication bus. In another embodiment, satellite radio receiver system 136 is embedded within the telematics unit 120. In one embodiment, satellite radio receiver system 136 provides channel and signal information to telematics unit 120. Telematics unit 120 monitors, filters and sends signals that are received from satellite broadcast, radio broadcasts or other wireless communication systems to output devices such as speaker 132 and visual display devices 210 (shown in FIG. 2). In another embodiment, signals from satellite radio receiver system 136 are sent directly to output devices such as speakers and visual display devices 210 without the intervening telematics unit 120.

Figure 2:
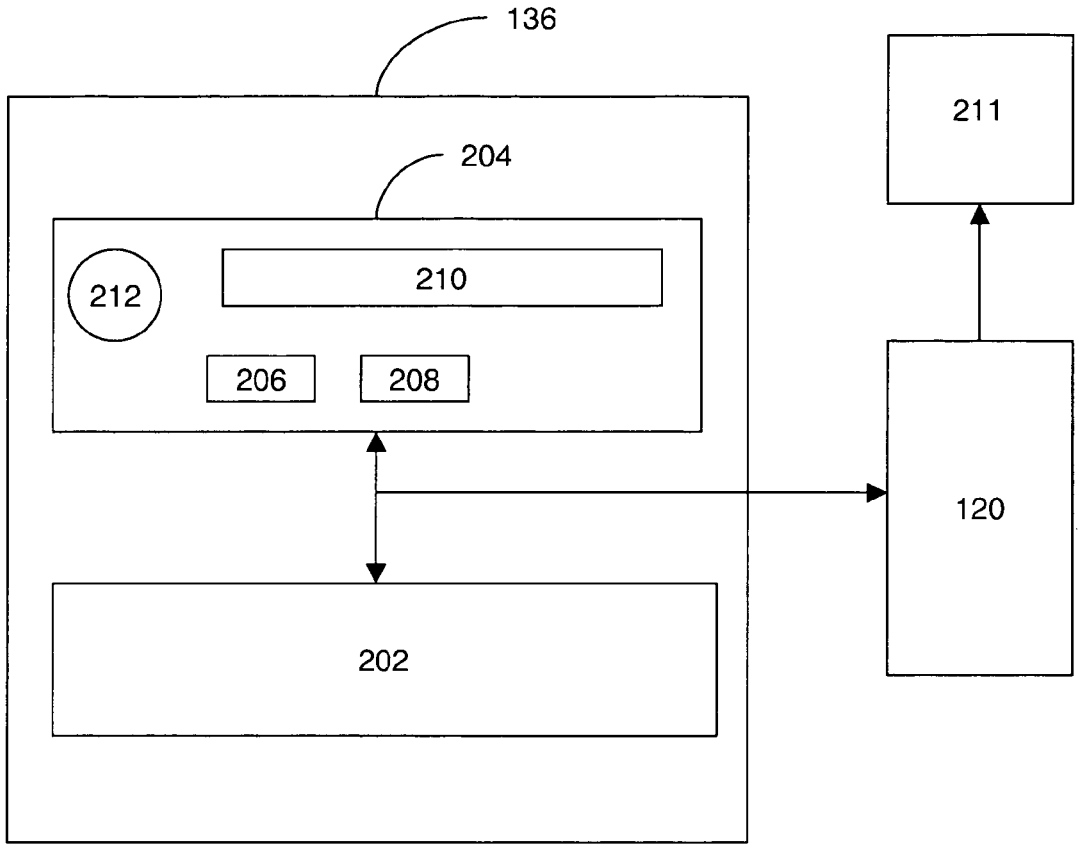
FIG. 2 is a schematic diagram of a satellite radio receiver system communicatively coupled to a telematics unit in accordance with the present invention.

FIG. 2 is a schematic diagram of one embodiment of satellite radio receiver system 136 communicatively coupled to telematics unit 120. Satellite radio receiver system 136 includes satellite radio receiver 202 and radio user interface 204. Satellite radio receiver 202 is any suitable hardware for receiving satellite radio broadcast signals in MVCU 110. Satellite radio receiver 202 receives digital signals from terrestrial radio transmitter 185 or a satellite radio geostationary satellite 190. Satellite radio receiver 202 is able to receive broadcast radio information over one or more satellite radio channels. Satellite radio receiver 202 is communicatively coupled to a speaker system (not shown) and generates an audio output via the speaker system.

Radio user interface 204 includes a satellite radio channel selector 206, a radio volume adjustor 208, a visual display device 210 and a mechanical input device 212. In one embodiment, visual display device 210 is an LCD display integral with radio user interface 204. In another embodiment, visual display device is a general vehicle visual display device under the control of telematics unit 120. In one embodiment, the text information embedded in the SDARS digital signal is extracted by satellite radio receiver 202 and routed to visual display device 210. In one embodiment, the text information is extracted by telematics unit 120 and routed to visual display device 210. In another embodiment, the text information is extracted by telematics unit 120 and routed to the general vehicle visual display device.

In one embodiment, mechanical input device 212 is a push button that can be pushed to initiate a data request for informational data associated with a broadcasted radio program. Depressing the push button 212 generates a request input signal. Telematics unit 120 monitors communications between satellite radio receiver 202 and user radio interface 204 for the input request signal. In another embodiment, the request input signal is generated responsive to a verbal user command communicated directly to telematics unit 120 via microphone 130. The voice-recognition application installed in processor 122 translates the verbal user command into a digital request input signal.

Figure 3:
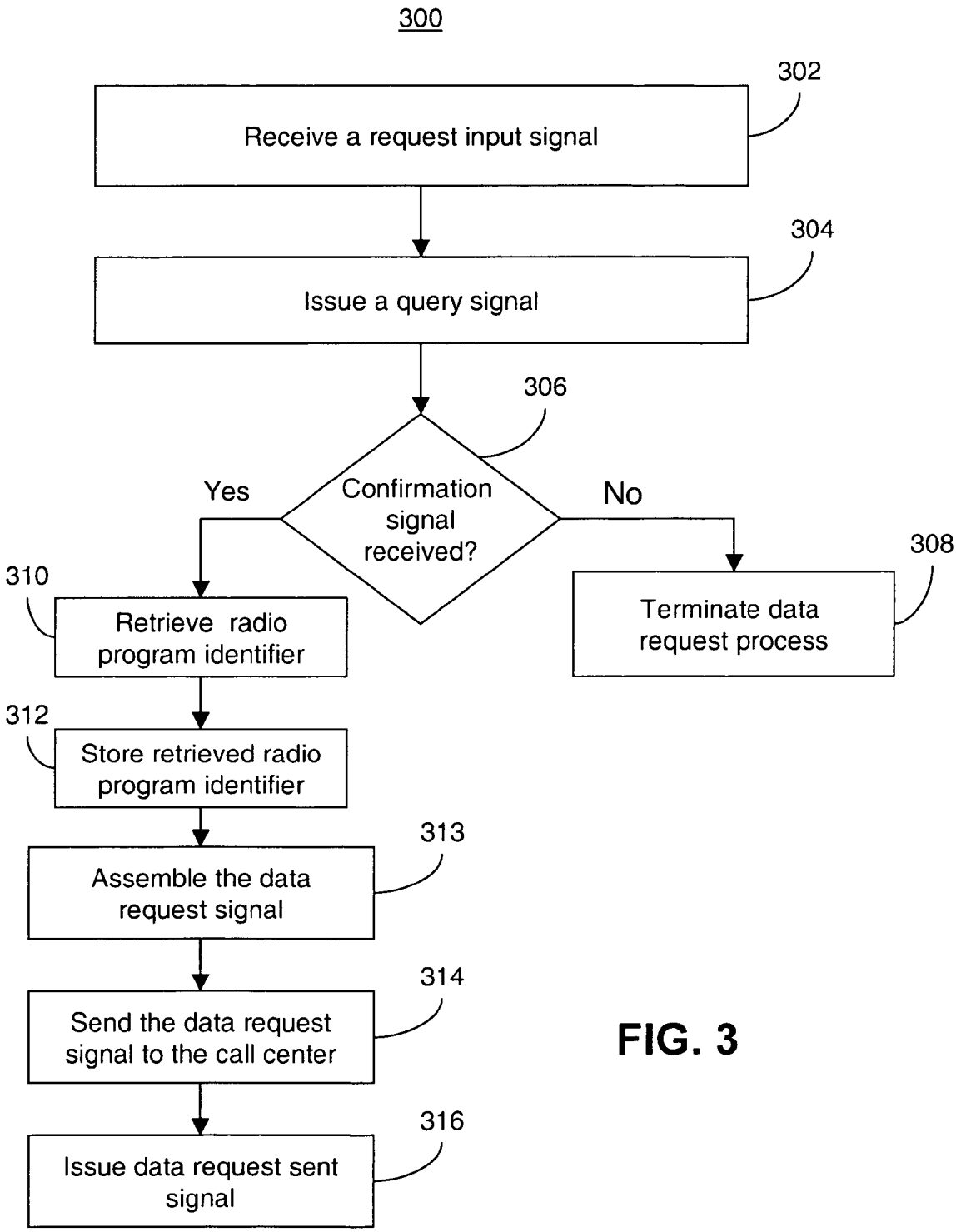
FIG. 3 illustrates a flowchart representative of one embodiment to send a data request for informational data associated with a transmitted satellite radio program to a call center from a telematics unit in accordance with the present invention.

FIG. 3 illustrates a flowchart 300 representative of one embodiment to send a data request for informational data associated with a transmitted satellite radio program to call center 170 in accordance with the present invention. The following discussion of flowchart 300 is related to exemplary mobile vehicle communication system (MVCS) 100 as shown in FIG. 1.

When the user of a mobile vehicle 110 listens to a satellite radio program, the user has the option of requesting informational data associated with a satellite radio program. In one embodiment, the user initiates the data request process via mechanical input device 212. In one embodiment, mechanical input device 212 is a push button. When the push button is depressed by the user, a request input signal is generated. Telematics unit 120 monitors signals generated by mechanical input device 212 and receives the request input signal (block 302). In another embodiment, the user can initiate the data request process using a verbal user command. The request input signal is generated responsive to the verbal user command picked up by microphone 130. The voice-recognition application installed in processor 122 in telematics unit 120 translates the verbal user command into a digital request input signal (block 302).

Upon receipt of the request input signal, telematics unit 120 issues a query signal (block 304) to determine whether the user desires to proceed with the data request. In the embodiment where the user initiated the data request process via mechanical input device 212, telematics unit 120 issues a text query signal to visual display device 210. In one embodiment, the text query signal displays the question "SET MARK?" on the visual display device 210 for a predetermined period of time. In one embodiment, the text query is displayed for five approximately seconds. In the embodiment where the data request process was initiated by verbal user command, telematics unit 120 issues a verbal query signal. In one embodiment, the verbal query "SET MARK?" is generated via one or more speakers 132.

Telematics unit 120 determines whether a confirmation signal has been received (block 306). The user has a predetermined period of time to confirm a desire to proceed with the data request process. In the embodiment where the data request process was initiated via mechanical input device 212, the user has a predetermined period of time to respond to the query "SET MARK?" displayed on the visual display device 210. In one embodiment, the predetermined period of time is approximately five seconds. If the predetermined period of time passes without telematics unit 120 receiving a confirmation signal, the data request process is terminated (block 308). If the user wishes to continue with the data request process, the user issues a confirmation signal to telematics unit 120 by depressing the push button within the predetermined period of time. Depressing the push button generates the confirmation signal.

In the embodiment where the data request process was initiated via a verbal user command, the user has a predetermined period of time to respond to the verbal query issued by telematics unit 120. If a confirmation signal is not received by telematics unit 120, the data request process is terminated (block 308). If the user wishes to continue with the data request process, the user issues a verbal user command within the predetermined period of time. The verbal user command is communicated to telematics unit 120 via microphone 130.

The voice-recognition application installed in processor 122 in telematics unit 120 translates the verbal user command into a digital confirmation signal (block 302).

If telematics unit 120 receives a confirmation signal, telematics unit 120 retrieves one or more radio program identifiers (block 310). In one embodiment, the radio program identifiers consist of the number of the satellite radio channel broadcasting the radio program and the radio program broadcast time. Telematics unit 120 retrieves the satellite radio channel number setting from the satellite radio receiver 204 and the broadcast time from GPS unit 126. Telematics unit 120 stores the retrieved satellite radio channel number and time stamp in the in-vehicle memory 128 (block 312). In another embodiment, the radio program identifier consists of a unique satellite radio program identifier assigned to the radio program by the SDARS provider. The unique satellite radio program identifier is embedded in the SDARS digital broadcast signal. Telematics unit 120 retrieves the unique satellite radio program identifier from the satellite radio receiver 202. Telematics unit 120 stores the retrieved unique satellite radio program identifier in the in-vehicle memory 128 (block 312).

Every mobile vehicle 110 has a unique mobile vehicle identifier. In one embodiment, telematics unit 120 retrieves the stored radio program identifier, and the unique mobile vehicle identifier. Telematics unit 120 embeds the retrieved radio program identifier and the unique mobile vehicle identifier in the data request signal and then transmits the data request signal to call center 170 via the wireless network (block 314). In another embodiment, call center 170 periodically issues a call center query to telematics unit 120. Telematics unit 120 responds to the call center query by checking to see if the mobile vehicle is in operation. If the mobile vehicle is not in operation, telematics unit 120 retrieves the stored radio program identifier and the unique mobile vehicle identifier, embeds the retrieved radio program identifier and unique mobile vehicle identifier in the data request signal and transmits the data request signal to call center 170.

Once the data request has been sent to call center 170, telematics unit 120 issues a data request sent signal (block 316). In the embodiment where the data request process was initiated by the user via mechanical input device 212, telematics unit 120 issues a data request sent signal to visual display device 210. In one embodiment, visual display device 210 displays "MARK SENT!" for a predetermined period of time responsive to the date request sent signal. In one embodiment, the predetermined period of time is approximately five seconds. In the embodiment where the data request process was initiated by a verbal user command, telematics unit 120 issues a verbal data request sent signal. In one embodiment, the comment "MARK SENT!" is generated via one or more speakers 132 responsive to the verbal data request signal. In the embodiment where telematics unit 120 transmitted the data request responsive to a call center query, telematics unit 120 performs a check to ensure that the mobile vehicle is in operation prior to issuing the data request sent signal.

Figure 4:
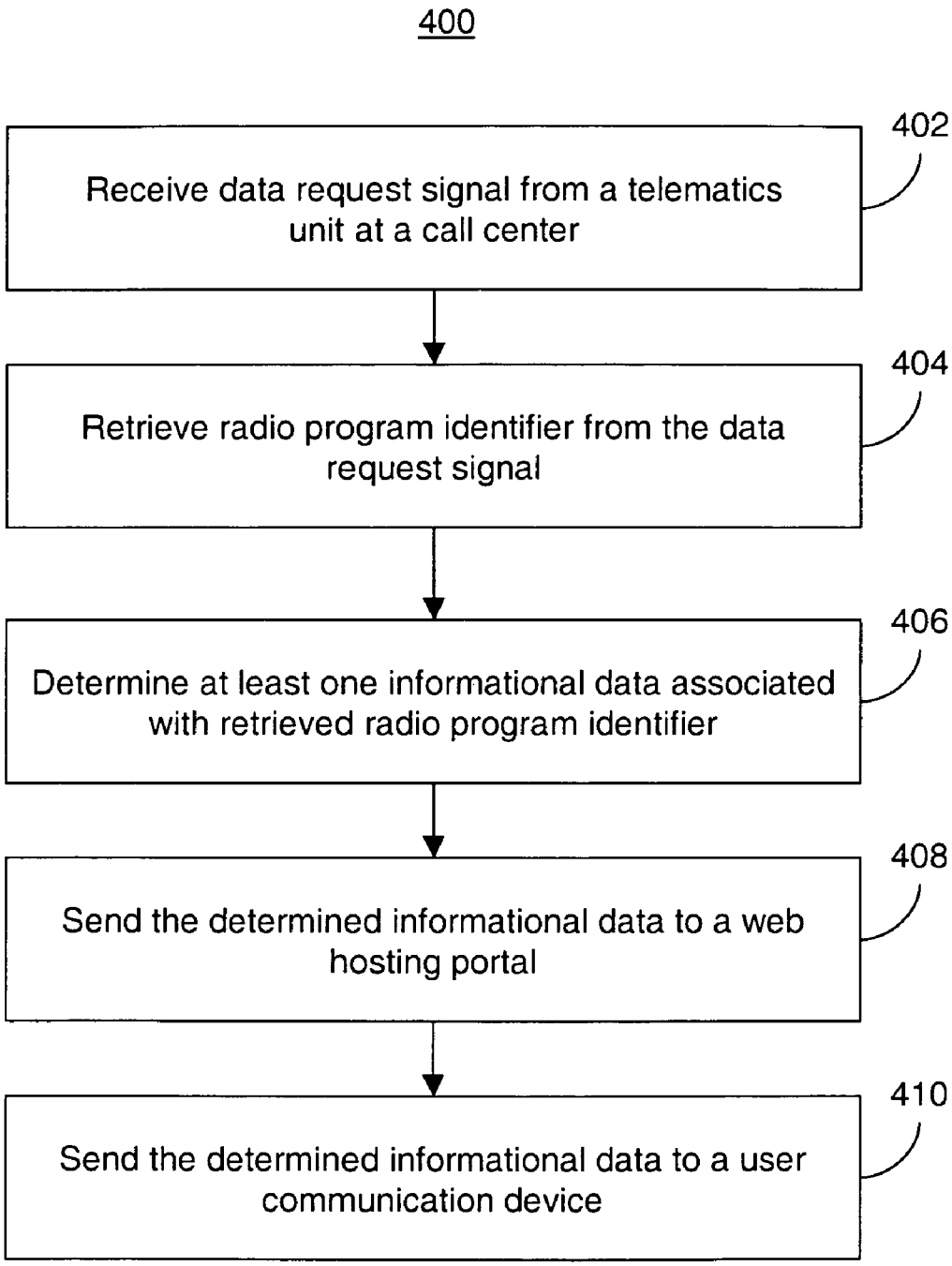
FIG. 4 illustrates a flowchart representative of one embodiment to provide a user of a mobile vehicle with informational data associated with a transmitted satellite radio program in accordance with the present invention.

FIG. 4 illustrates a flowchart 400 representative of one embodiment to provide a user of a mobile vehicle with informational data associated with a satellite radio program from call center 170 in accordance with the present invention.

Communications service manager 174 at call center 170 receives the data request for informational data associated with the broadcasted radio program from the mobile vehicle user via telematics unit 120 (block 402). In one embodiment, the data request is transmitted to call center 170 as soon as the date request is processed by telematics unit 120. In another embodiment, communications service manager 174 issues a periodic call center query to telematics unit 120. The data request is transmitted to call center 170 responsive to a call center query.

Communications service manager 174 retrieves the radio program identifier embedded in the data request (block 404). Communications service manager 174 also retrieves the unique mobile vehicle identifier embedded in the data request.

In one embodiment, the radio program identifier consists of the number of the satellite radio channel that broadcasted the selected radio program and the radio program broadcast time.

Call center 170 has one or more databases 176 dedicated to storing informational data associated with SDARS radio programs. Communications service manager 174 extracts the informational data embedded in broadcasted SDARS digital signals. In one embodiment, the extracted informational data includes the names of the broadcasted radio program and of the radio program artist. For example, if the radio program is a song, the extracted informational data consists of the song title and the name of the singer. The informational data is stored in data sets. The data set includes the name of the radio program, the radio program artist, the radio program broadcast time and the satellite radio channel number on which the radio program was broadcast. The data sets are stored in the informational database 176.

Communications service manager 174 accesses the informational database 176 to determine the informational data associated with the radio program identifier retrieved from the data request (block 404). More specifically, communications service manager 174 uses the radio program identifier, the satellite radio channel number and radio program broadcast time, to identify the relevant data set in the informational database 176. Communications service manager 174 retrieves the names of the radio program and of the radio program artist from the identified data set.

In another embodiment, the radio program identifier embedded in the data request consists of a unique satellite radio program identifier assigned to the broadcasted program by the SDARS provider.

The SDARS digital signal transmits the unique satellite radio program identifier concurrently with the associated satellite radio program. Call center 170 obtains a listing of the unique satellite radio program identifiers, the associated names of the radio programs and of the radio program artists from the SDARS provider. In one embodiment, the unique satellite radio identifier is associated with a specific version of the radio program. Each data set includes the unique satellite radio program identifier, the associated radio program name and radio program artist. The data sets are stored in informational database 176.

Communications service manager 174 accesses the informational database 176 to determine the informational data associated with the radio program identifier retrieved from the data request (block 404). More specifically, communications service manager 174 uses the radio program identifier, the unique satellite radio identifier, to identify the relevant data set in the informational database 176. Communications service manager 174 retrieves the name of the radio program and the radio program artist from the identified data set.

In another embodiment, each data set also includes links to third party websites with additional information pertaining to the broadcasted radio program. Examples of such third party websites include, but are not limited to, websites listing performance schedules, websites with biographies of the artist performing the broadcasted radio program, fan websites for the artist, websites listing broadcasted song lyrics, websites for purchasing CDs for the radio program and other websites containing information related to the broadcasted audio program. Communications service manager 174 retrieves the third party website links from the identified data set.

In another embodiment, communications service manager 174 identifies the data sets for the radio programs broadcasted before and after the user selected radio program on the same satellite radio channel. Communications service manager 174 retrieves the informational data stored in these data sets. This is to ensure that the user receives the informational data associated with the desired radio program in the event the user inadvertently initiates the data request process at a time prior to the beginning of or following the conclusion of the desired radio program broadcast.

Communications service manager 174 sends the determined informational data consisting of the informational data retrieved from the informational database 176 along with the unique mobile vehicle identifier to web hosting portal 160 (block 408).

At the request of a mobile vehicle user, web hosting portal 160 stores an email address for the mobile vehicle user. The email addresses are stored in mobile vehicle user specific files in database 166. Web server 164 uses the received unique mobile vehicle identifier to identify the appropriate mobile vehicle user file and retrieves the email address for the mobile vehicle user. The received informational data is sent in to a mobile vehicle user communication device at the retrieved email address (block 410). In one embodiment, the mobile vehicle user communication device is user computer 150. In one embodiment, the mobile vehicle user communication device is a PDA. In another embodiment, mobile vehicle user communication device is a cell phone.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A method for providing a user of a mobile vehicle with program information describing a transmitted satellite radio program, the method comprising:

receiving a request input signal at the vehicle from a user and in response, issuing a query signal to determine whether the user desires to proceed with a data request, and setting a timeout value;

if a user confirmation is received within a period of time allowed by the time out value, sending a data request for data associated with a currently playing radio program to a call center from a telematics unit of the vehicle via a wireless network;

determining program information responsive to the data request and associated with the currently playing radio program at the call center; retrieving an email address of the user associated with mobile vehicle; and emailing the determined program information from the call center via the retrieved email address to a personal computer distinct from the telematics unit and remote from the mobile vehicle such that the user may retrieve the transmitted information at a later time via the personal computer.

2. The method of claim 1, further comprising:

retrieving the program information from a satellite radio transmission at the call center;

storing the retrieved program information in a call center database; and retrieving at least a portion of the stored program information from the call center database.

3. The method of claim 1, wherein the data request includes at least one radio program identifier and wherein the program data is determined based on the radio program identifier.

4. The method of claim 3, wherein the radio program identifier includes a time stamp and a satellite radio channel number.

5. The method of claim 3, wherein the radio program identifier includes a unique satellite radio program identifier.

6. The method of claim 3, further comprising receiving a request input signal from the user at the telematics unit, and retrieving the radio program identifier responsive to the request input signal.

7. The method of claim 1, wherein receiving a request input signal at the vehicle from the user further comprises receiving the request input signal responsive to a user input command selected from a group consisting of a mechanical input device generated command and a verbal user command.

8. A system for providing a user of a mobile vehicle with information associated with a transmitted satellite radio program, the system comprising:

means for receiving a request input signal at the vehicle from a user and in response, issuing a query signal to determine whether the user desires to proceed with a data request, and setting a timeout value; means for sending a data request for data associated with a currently playing radio program to a call center from a telematics unit of the vehicle via a wireless network if a user confirmation is received within a period of time allowed by the time out value; and means for receiving the data request at the call center and determining at least one informational data associated with the data request and relating to the currently playing song;

means for retrieving an email address associated with a user of the mobile vehicle; and means for sending the determined informational data to a personal computer associated with the user for later retrieval, wherein the personal computer is distinct from the telematics unit and remote from the vehicle.

9. The system of claim 8, further comprising:

means for retrieving the informational data from a satellite radio transmission at the call center;

means for storing the retrieved informational data in a call center database; and means for retrieving at least one informational data associated with the data request from the call center database.

10. The system of claim 8, wherein the data request includes at least one radio program identifier and wherein the means for determining at least one informational data comprises means for determining the informational data based on the radio program identifier.

11. The system of claim 10, wherein the radio program identifier includes a time stamp and a satellite radio channel number.

12. The system of claim 10, wherein the radio program identifier includes a unique satellite radio program identifier.

13. The system of claim 10, further comprising means for retrieving the radio program identifier responsive to the request input signal.

14. The system of claim 13, wherein the means for receiving a request input signal further includes means for generating the request input signal responsive to a user input command selected from a group consisting of a mechanical input device generated command and a verbal user command.

* * * * *